United States Patent [19]

Lamy

[11] 4,249,618

[45] Feb. 10, 1981

[54] METHOD AND APPARATUS FOR THE WORKING OF UNDERWATER DEPOSITS

[75] Inventor: Jacques E. Lamy, Fontenay-Aux-Roses, France

[73] Assignee: Compagnie Generale pour les Developpements Operationnels des Richesses Sous-Marines, Paris, France

[21] Appl. No.: 970,108

[22] Filed: Dec. 18, 1978

[30] Foreign Application Priority Data

Dec. 19, 1977 [FR] France ..... 77 38342

[51] Int. Cl.[3] ..... E21B 7/136

[52] U.S. Cl. ..... 175/9; 166/362; 405/204

[58] Field of Search ..... 405/203, 204, 205, 207, 405/210; 175/5, 8, 9; 166/362

[56] References Cited

U.S. PATENT DOCUMENTS

| | | | |
|---|---|---|---|
| 3,001,595 | 9/1961 | Lucas | 175/9 |
| 3,307,624 | 3/1967 | Lubinski | 175/9 X |
| 3,362,170 | 1/1968 | Manning | 175/9 X |
| 3,575,005 | 6/1967 | Sumner | 175/9 X |
| 3,657,895 | 4/1972 | Phelps | 405/210 |
| 3,906,735 | 9/1975 | Mo | 405/207 |
| 3,965,688 | 6/1976 | Jensen | 405/205 |
| 4,002,038 | 1/1977 | Phares et al. | 405/203 |

*Primary Examiner*—James A. Leppink
*Assistant Examiner*—Richard E. Favreau
*Attorney, Agent, or Firm*—Wigman & Cohen

[57] ABSTRACT

A method of working an underwater deposit comprises the following stages:

(a) constructing and positioning a platform structure, equipped before or after positioning with drilling devices and installations, (b) executing drilling using these devices and installations, (c) constructing and equipping, during stages (a) and (b), a production bridge fitted with devices and installations required for production, (d) transporting the production bridge to, and positioning it on, said platform structure, and (e) commencing production from deposit.

The drilling bridge may remain in position on the platform structure during stages (d) and (e), or it may be removed to make way for the production bridge.

5 Claims, 8 Drawing Figures

Figure 1:
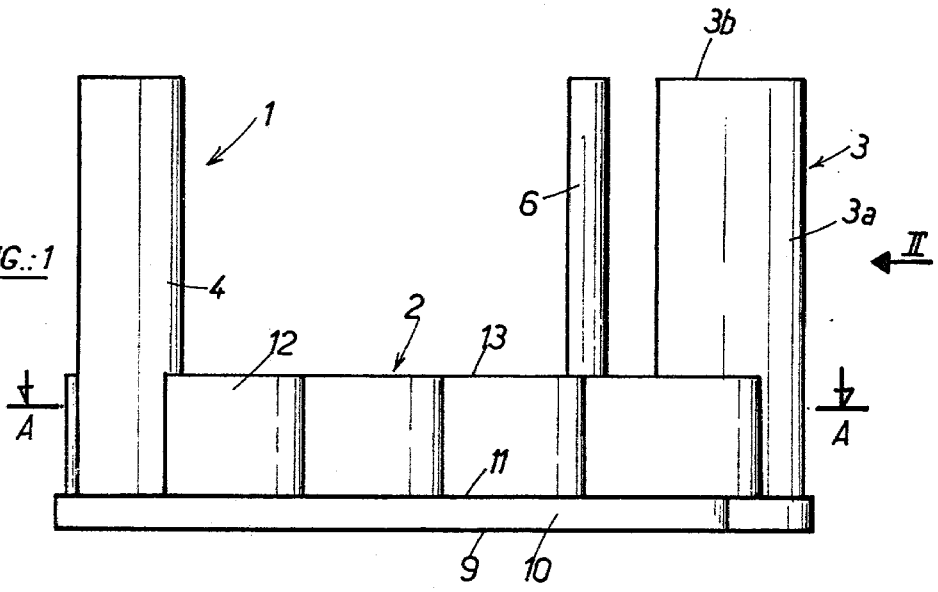

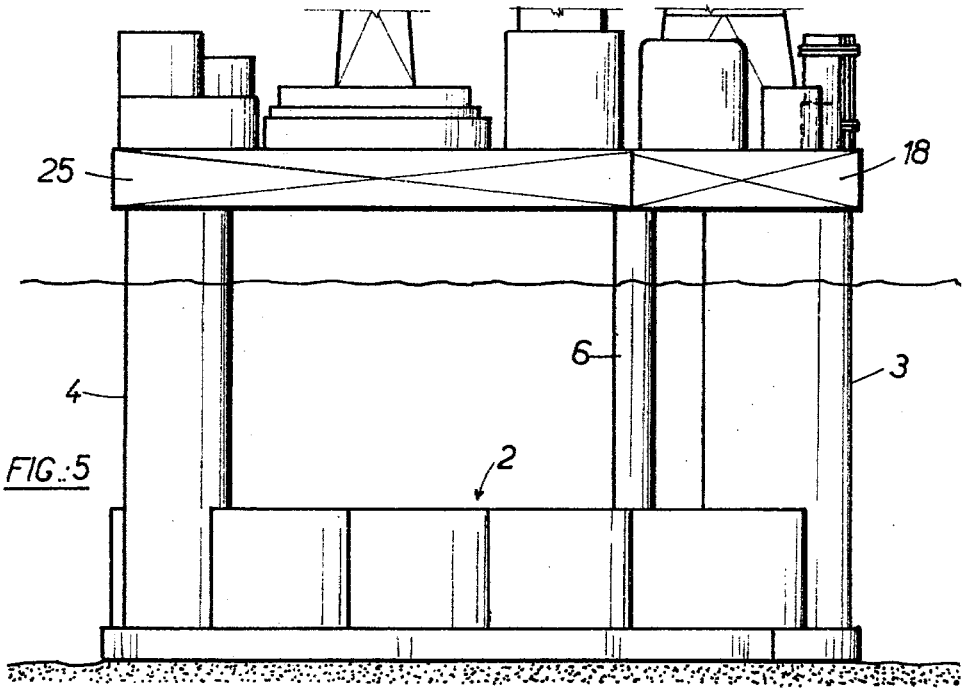
FIG.:5
FIG.:5a
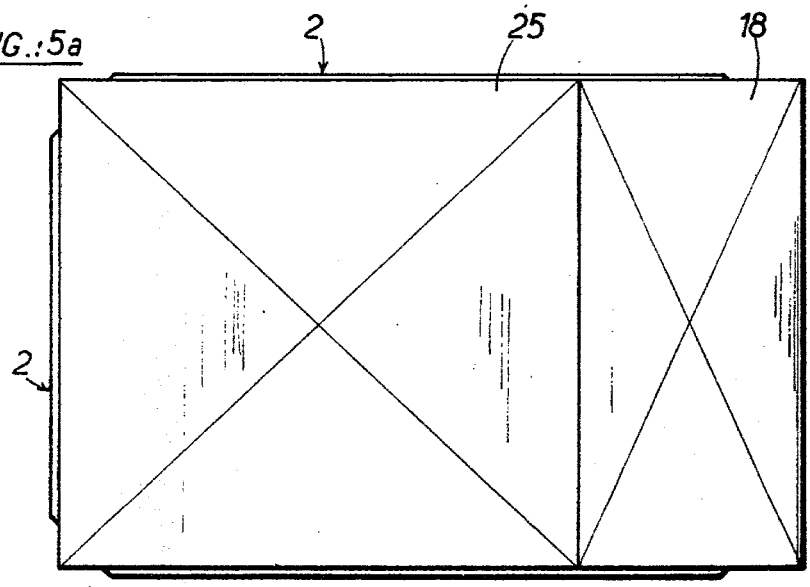

METHOD AND APPARATUS FOR THE WORKING OF UNDERWATER DEPOSITS

The invention refers to the working of underwater deposits, particularly oil deposits and, more precisely, concerns a method and apparatus for drilling and working such a deposit.

Working a deposit of hydrocarbon using an underwater drilling/production platform requires a length of time which is a function of delivery dates of the platform, of provision of drilling and production equipment, as well as the drilling period. Experience has shown that under present conditions the longest delays concern the provision of production equipment (separators, compressors etc.). For instance, the time required to provide these devices and installations is of the order of two years, that is, much longer than the time required to build the platform itself. In addition, production can only be begun after drilling has been carried out, that is, in some cases three years or more after the first order.

The aim of the invention is to enable a substantial reduction to be made in the time required before production from underwater deposits can be begun, without involving these different delays.

In accordance with this invention, a method of working an underwater deposit comprises the following stages:

(a) construction and positioning of a platform structure, equipped before or after positioning with drilling devices and installations, (b) execution of drilling using said devices and installations, (c) construction and equipment, during stages (a) and (b), of a production bridge fitted with devices and installations required for production, (d) transport of the production bridge to, and positioning it on, said platform structure, and (e) commencement of production from deposit.

The construction of the production bridge is relatively rapid. It is best carried out during the period when the production equipment is being manufactured and delivered. The time required before commencement of production is thus reduced to the longer of the two following periods: the period required for construction and positioning of the platform structure with its drilling equipment, and for drilling a well; or the period required for manufacture and supply of production equipment, for its positioning on the production bridge, and installation of the bridge onto the platform, i.e. reduced to a notably shorter period than those involved in the previous technique.

The drilling equipment can be placed on a temporary bridge which is fixed to the platform structure for the drilling period and removed afterwards to make way for the bridge fitted with production equipment; this can then be fitted with well maintenance equipment. However, the drilling equipment should preferably be mounted on a drilling bridge which remains fixed to the platform structure both during and after positioning of the production bridge; thus drilling can be carried out without interruption.

The invention also includes apparatus for carrying out the method defined above, comprising: a platform structure for location resting on the bed of the sea or an area of water, the said structure being fitted with drilling devices and installations, and provided with supports capable of receiving a production bridge; a production bridge, fitted with production devices and installations; and means for transporting the production bridge to the platform structure and of placing it on the said supports.

The drilling devices and installations can be mounted on a bridge and this then placed on the structure before or after positioning of the structure. The supports can be designed to receive one or more bridges at a later date.

In one embodiment of the invention the platform structure comprises a base enclosing a chamber suitably divided into water-tight compartments forming ballastable floats, a hollow shaft rising vertically at one end of the base and supporting a drilling bridge which in turn supports devices and installations enabling drilling to be carried out through the hollow shaft, and a plurality of columns, preferably hollow, rising vertically and designed to carry the production bridge next to the drilling bridge.

Owing to its advanced development, the base can form, in this apparatus, a float which is capable of supporting the base structure in the water and, eventually, the drilling bridge. In addition there is no need for the hollow shaft to form a float, and it is not necessary to seal off its lower end with a plate, which is an advantage in areas where seismic shocks occur, as will be explained later.

Figure 1A:
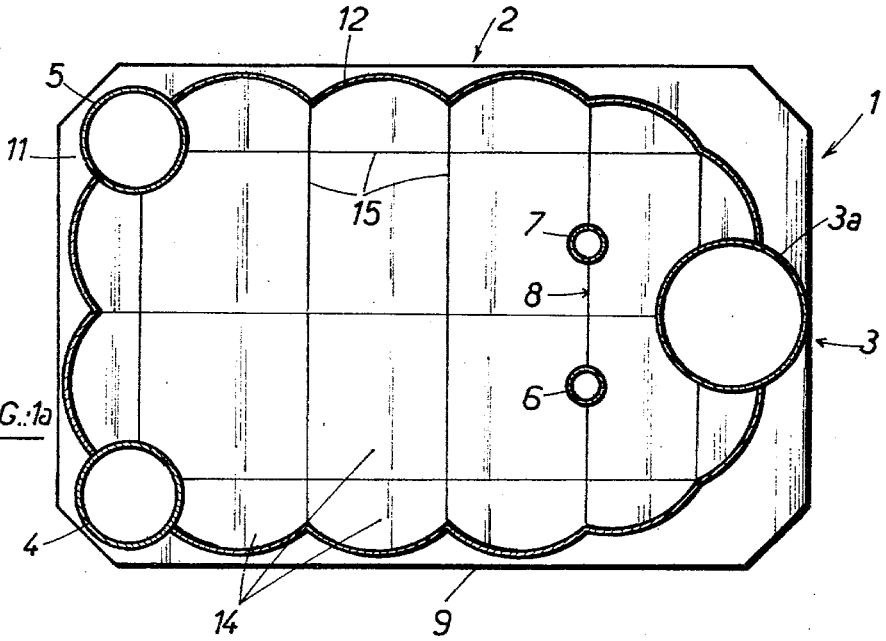
Figure 2:
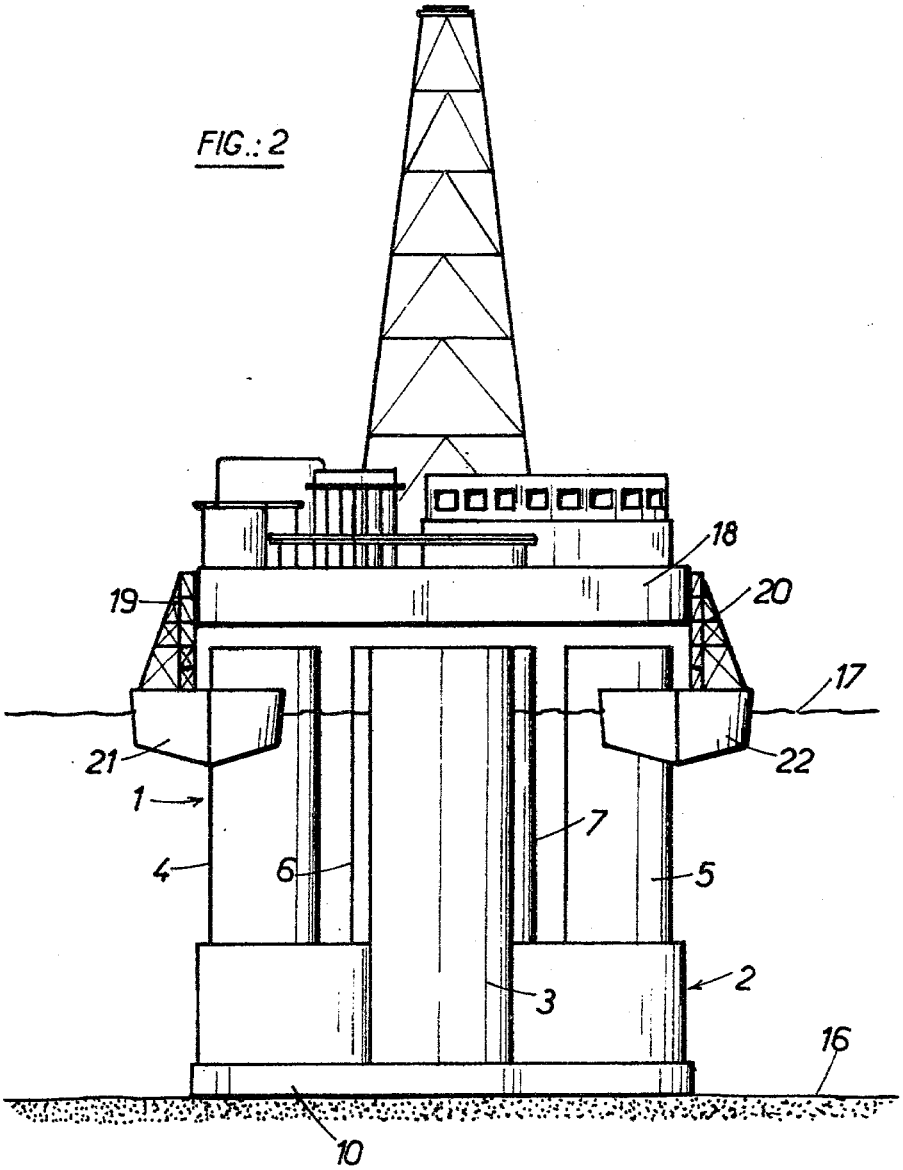
Figure 3:
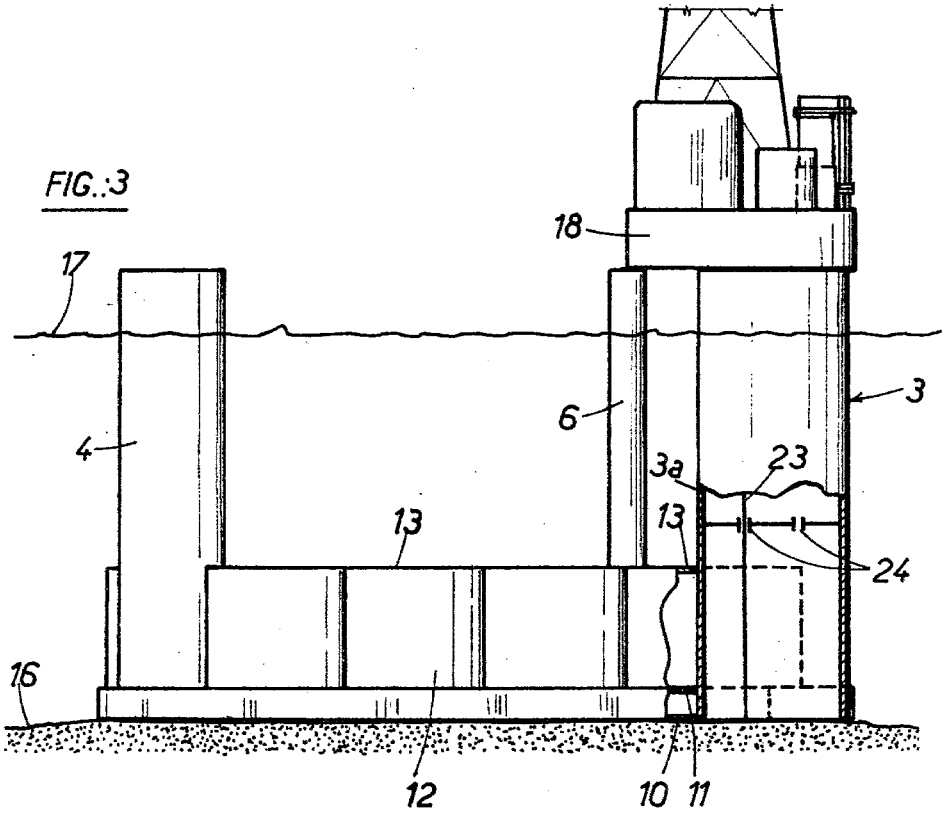
Figure 3A:
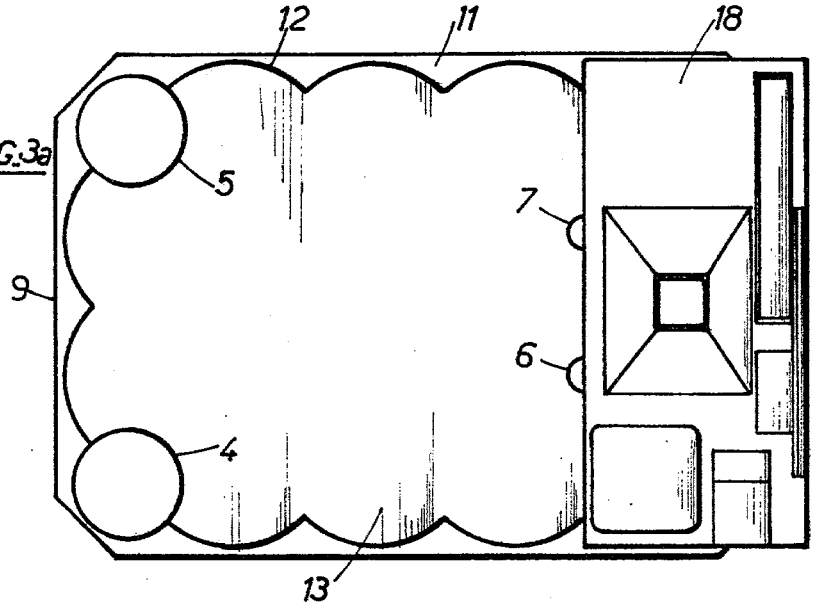
Figure 4:
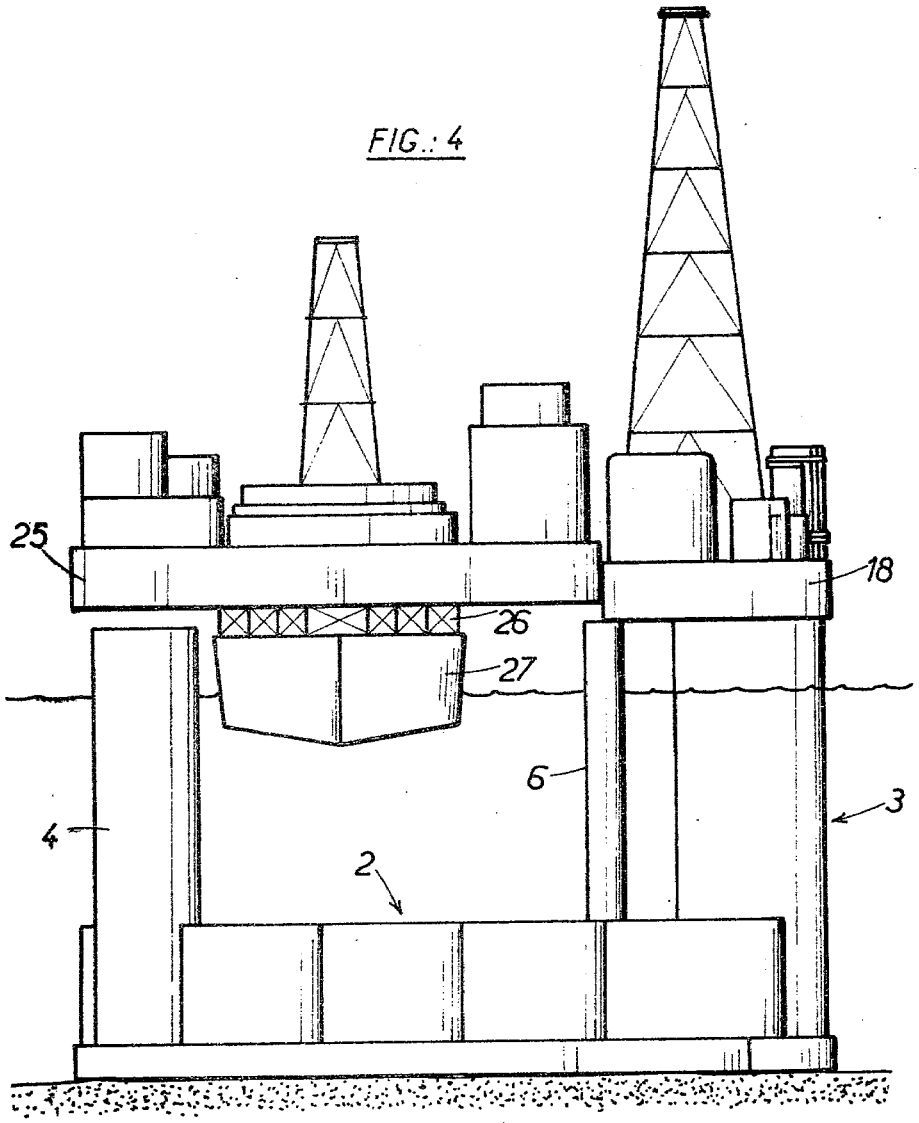

The following description is not exhaustive, but by way of example will enable a better understanding of the advantages of the invention and of its realisation, reference being made to the accompanying drawings, in which:

FIG. 1 is a schematic side elevation of a platform structure according to the invention, FIG. 1*a* is a horizontal section along the line A—A of FIG. 1, FIG. 2 is a schematic front elevation looking in the direction of the arrow II of FIG. 1, illustrating the positioning of the drilling bridge, FIG. 3 is a similar view to FIG. 3, partly in section, showing the drilling bridge supported by the platform structure, FIG. 3*a* is a schematic plan view of the construction of FIG. 3, FIG. 4 is a similar view to FIG. 3, illustrating the position of the production bridge, FIG. 5 is a similar view to FIG. 3, showing the platform structure supporting the drilling bridge and the production bridge, and FIG. 5*a* is a schematic plan view of the construction of FIG. 5.

The platform structure, shown diagrammatically, is indicated at 1 in FIGS. 1 and 2 and is of the "base-weighted" type, that is, capable of resting on the sea bed by its own weight. It is designed for working an oil deposit. This structure 1 is constructed of concrete and consists of a horizontal base 2 of general rectangular shape, a hollow shaft 3 rising vertically near the center of one of the short sides of the rectangle, two hollow columns 4, 5 rising vertically at the two corners opposite this short side, and two other vertical columns 6, 7 of smaller diameter, placed symmetrically on line 8 parallel to the said short side of the rectangle at a distance from the hollow shaft 3 equal to the radius of this shaft the distance between the two columns 6, 7 being approximately equal to the diameter of the hollow shaft 3. As can be seen from the drawings, the tops of the shaft 3 and columns 4, 5, 6, 7 are at the same height.

The base 2 comprises a floor 10 sealed at its lower surface by a plate 9 forming a strengthening floor, and at its upper surface by another plate 11 forming a base plate, which supports a vertical wall 12 in the form of a lobed rectangle fitted with an upper surface plate 13 so as to form a water-tight chamber divided into compartments 14 by water-tight partitions 15. The hollow shaft 3 comprises an open-ended cylindrical casing 3*a*; its foot is embedded in the base 2, but it is completely open at its lower end. In other words, plates 9, 11 and 13 are interrupted at the cylindrical casing 3*a*, as can be seen in FIG. 3. Hollow columns 4, 5, 6, 7 are water-tight and are also embedded in the base 2.

In the embodiment shown, compartments 14 of the base have sufficient capacity, when they are full of air, to form a float capable of supporting the platform structure 1 at the surface of the water. They are fitted with devices (not shown) which enable them to be ballasted as required. The platform structure 1 is constructed on shore, for example on coastal mudflats adjacent the sea, then is towed, being kept afloat by the base, to its final site, where an oil deposit has been found. Here, the compartments 14 are gradually ballasted in order to place the base 2 gently on the sea bed 16 (FIGS. 2 and 3). During this operation, the stability of the structure is assured by floats, i.e. hollow columns 4, 5, 6, 7, from the moment the base 2 is completely immersed. As can be seen from the drawings, the height of shaft 3 and columns 4, 5, 6, 7 is such that they stand about 10 meters above the surface of the water when the plate 9 rests on the sea bed 16.

During the construction of structure 1, a drilling bridge 18 would have been built and fitted with the devices and installations required for drilling (derrick or drilling tower, preparation and mud injection units, storage for pulverulents, rod store, power plant, drillers' quarters, etc.). These fitments are standard and can be supplied very quickly. Bridge 18 is fixed at the sides to supports 19, 20 mounted respectively on two floats 21, 22 (FIG. 2), thus forming a sort of catamaran which is towed to the structure 1 and located at the sides above this so that the bridge 18 overlies the shaft 3 and half the top surface of columns 6 and 7. The supports 19, 20 are fitted with means (not shown) for lowering the bridge 18 gently until it rests on the hollow shaft 3 and on hollow columns 6 and 7 (FIGS. 3 and 3*a*). After fixing the bridge to the shaft and the columns, drilling can be continued in the normal way.

It should be noted that, as the interior of the hollow shaft 3 does not include a horizontal plate, the drilling rods, such as 23, are not restrained at the exit to the sea bed 16 at the lower end of the shaft, and do not risk being sheared by relative displacements of the platform 1 and the sea bed 16 caused by seismic shocks. The drilling rods, such as 23, are held in place to the best advantage by guides 24 mounted in the hollow shaft 3 at a certain height above the sea bed 16.

During the construction and equipping of the structure 1 and of the bridge 18, and during the beginning at least of drilling, the supply of devices and installations for production is begun, as well as the construction of a production bridge 25 (FIG. 4) and the positioning of these devices and installations on bridge 25. The bridge 25 is placed on a support 26 mounted on a barge 27 (FIG. 4) and while drilling continues, the barge 27 is towed to the structure 1, and located alongside this between columns 4, 5 and columns 6, 7 so that the bridge 25 comes into position above columns 4 and 5, and the part not occupied by bridge 18 of the top surface of columns 6 and 7. The barge 27 is then ballasted so that the bridge 25 comes into position on the columns (FIGS. 5 and 5*a*) and is then fixed into position on the tops of these columns.

Production drilling can then be begun.

The described embodiment is only an example in accordance with the invention, and it would be possible to modify it, particularly by substituting equivalent techniques, without deviating from the scope of the invention as defined in the appended claims. In particular, if the platform had to be installed in an area exposed to seismic shocks, and if the volume of the float formed by the base was insufficient to support the platform structure by itself, the hollow shaft 3 could be partitioned off by horizontal plates positioned at a certain height above its base so as to form a complementary float without the risk of shearing the drilling rods. Although the platform described is constructed of concrete, it would not be deviating from the invention to construct it of other materials, for example of metal or of a combination of concrete and metal.

I claim:

1. Apparatus for working an underwater deposit comprising:

a platform structure for location resting on the bed of an area of water;

drilling devices and installations fitted on said platform structure;

supports on the platform structure capable of receiving a production bridge;

a production bridge;

production devices and installations fitted on the production bridge;

means for transporting the production bridge to the platform structure and of placing it on the said supports;

wherein the platform structure comprises a base enclosing a chamber suitably divided into water-tight compartments forming ballastable floats, a hollow shaft rising vertically at one end of the base, a drilling bridge supported by the hollow shaft, devices and installations, supported by the drilling bridge, enabling drilling to be carried out through the hollow shaft, and a plurality of columns rising vertically and designed to carry the production bridge next to the drilling bridge; and wherein the columns are separated into two groups with sufficient room between them to allow a float to pass supporting the production bridge in order to place this on said columns.

2. Apparatus for working an underwater deposit comprising:

a platform structure for location resting on the bed of an area of water;

drilling devices and installations fitted on said platform structure;

supports on the platform structure capable of receiving a production bridge;

a production bridge;

production devices and installations fitted on the production bridge;

means for transporting the production bridge to the platform structure and of placing it on the said supports;

wherein the platform structure comprises a base enclosing a chamber suitably divided into water-tight compartments forming ballastable floats, a hollow shaft rising vertically at one end of the base, a drilling bridge supported by the hollow shaft, devices and installations, supported by the drilling bridge, enabling drilling to be carried out through the hollow shaft, and a plurality of columns rising vertically and designed to carry the production bridge next to the drilling bridge; and wherein the drilling devices and installations are located on the drilling bridge which is supported by the hollow shaft and by two columns with a distance between them equal to the diameter of the said hollow shaft so that the said production bridge can be placed in position by means of two floats forming with it a catamaran which straddles the said hollow shaft and the said columns.

3. Apparatus for working an underwater deposit comprising:

a platform structure for location resting on the bed of an area of water;

drilling devices and installations fitted on said platform structure;

supports on the platform structure capable of receiving a production bridge;

a production bridge;

production devices and installations fitted on the production bridge;

means for transporting the production bridge to the platform structure and of placing it on the said supports;

wherein the platform structure comprises a base enclosing a chamber suitably divided into water-tight compartments forming ballastable floats, a hollow shaft rising vertically at one end of the base, a drilling bridge supported by the hollow shaft, devices and installations, supported by the drilling bridge, enabling drilling to be carried out through the hollow shaft, and a plurality of columns rising vertically and designed to carry the production bridge next to the drilling bridge; and in which the base has on its underside a plate forming a strengthening floor, wherein this plate stops at the hollow shaft, so that drilling rods emerging from the lower end of the hollow shaft are not restrained by said plate and do not risk being sheared by seismic shocks.

4. Apparatus according to claim 1 or 2 or 3, wherein the drilling devices and installations are mounted on a drilling bridge, and wherein the drilling bridge is adapted to be placed on the structure.

5. Apparatus according to claim 1 or 2 or 3, wherein the supports have means to receive at least one other bridge at a later date.

* * * * *